US009859637B2

(12) United States Patent
Fu et al.

(10) Patent No.: US 9,859,637 B2
(45) Date of Patent: Jan. 2, 2018

(54) ELECTRICAL CONNECTOR

(71) Applicant: Tyco Electronics (Shanghai) Co. Ltd., Shanghai (CN)

(72) Inventors: Xiaozhi Fu, Shanghai (CN); Hongjun Yin, Shanghai (CN); Xiang Xu, Shanghai (CN); Ming Shi, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/861,448

(22) Filed: Sep. 22, 2015

(65) Prior Publication Data

US 2016/0087359 A1 Mar. 24, 2016

(30) Foreign Application Priority Data

Sep. 22, 2014 (CN) ..... 2014 2 0545833 U

(51) Int. Cl.

| | |
|---|---|
| ***H01R 12/75*** | (2011.01) |
| ***H01R 4/48*** | (2006.01) |
| ***H01R 12/71*** | (2011.01) |
| *H01R 12/51* | (2011.01) |

(52) U.S. Cl.

CPC ..... *H01R 12/75* (2013.01); *H01R 4/4818* (2013.01); *H01R 12/718* (2013.01); *H01R 12/515* (2013.01)

(58) Field of Classification Search

CPC .. H01R 4/4818; H01R 12/7076; H01R 11/28; Y10S 439/94

USPC ..... 439/884, 438–441, 775–864, 940

See application file for complete search history.

(56) References Cited

U.S. PATENT DOCUMENTS

| | | | | |
|---|---|---|---|---|
| 4,084,876 | A * | 4/1978 | Dinger | H01R 4/4818 439/439 |
| 4,299,436 | A * | 11/1981 | Ackerman | H01R 13/11 439/84 |
| 6,394,858 | B1 * | 5/2002 | Geltsch | H01R 9/2466 174/59 |
| 7,448,901 | B2 * | 11/2008 | Weber | H01R 4/4818 439/427 |
| 7,513,793 | B2 * | 4/2009 | Horst | H01R 4/4818 439/427 |
| 7,607,953 | B2 * | 10/2009 | Fabian | H01R 4/4818 439/789 |
| 7,704,103 | B1 * | 4/2010 | Rhein | H01R 13/113 439/752.5 |
| 7,722,382 | B2 * | 5/2010 | Landis | H01R 4/26 439/393 |
| 7,785,159 | B2 * | 8/2010 | Kumakura | H01R 4/185 439/845 |
| 7,976,351 | B2 * | 7/2011 | Boemmel | H01R 13/432 439/748 |
| 8,591,271 | B2 * | 11/2013 | Bies | H01R 4/4836 439/725 |
| 8,636,523 | B2 * | 1/2014 | Nagasaki | H01R 4/2404 439/439 |

(Continued)

FOREIGN PATENT DOCUMENTS

TW EP 2843765 A1 * 3/2015 ..... H01R 13/2407

*Primary Examiner* — Tulsidas C Patel
*Assistant Examiner* — Travis Chambers
(74) *Attorney, Agent, or Firm* — Barley Snyder

(57) ABSTRACT

An electrical connector is provided and includes a conductive terminal having a first end with a top flat surface.

12 Claims, 3 Drawing Sheets

(56) References Cited

U.S. PATENT DOCUMENTS

| | | | | |
|---|---|---|---|---|
| 8,721,376 | B1 * | 5/2014 | Bishop | H01R 12/57 439/441 |
| 8,968,022 | B2 * | 3/2015 | Mostoller | H01R 4/4836 439/438 |
| 9,209,530 | B2 * | 12/2015 | Gassauer | H01R 4/4836 |
| 9,306,297 | B2 * | 4/2016 | Bishop | H01R 4/4818 |
| 9,444,155 | B2 * | 9/2016 | Chen | H01R 4/48 |
| 9,472,871 | B2 * | 10/2016 | Lin | H01R 4/4836 |
| 9,543,682 | B2 * | 1/2017 | Jin | H01R 4/4836 |
| 9,548,564 | B2 * | 1/2017 | Wu | H01R 4/4836 |
| 2011/0318975 | A1 * | 12/2011 | Giefers | H01R 4/489 439/818 |
| 2014/0302693 | A1 * | 10/2014 | Bishop | H01R 4/4836 439/78 |
| 2015/0255923 | A1 * | 9/2015 | Xu | H01R 4/4836 439/345 |
| 2015/0340810 | A1 * | 11/2015 | Shi | H01R 4/2404 439/345 |
| 2016/0049745 | A1 * | 2/2016 | Jin | H01R 4/4836 439/733.1 |

* cited by examiner

ELECTRICAL CONNECTOR

CROSS-REFERENCE TO RELATED APPLICATIONS

This application claims the benefit of the filing date under 35 U.S.C. §119(a)-(d) of Chinese Patent Application No. 201420545833.1 filed on Sep. 22, 2014.

FIELD OF THE INVENTION

The invention relates to an electrical connector and, in particular, to an electrical connector adapted for a vacuum suction nozzle.

BACKGROUND

In the prior art, a known electrical connector generally includes an insulating housing and metal conductive terminals held in the insulating housing and other auxiliary parts. In order to mount a small electrical connector to a circuit board, a vacuum suction nozzle is generally required to position the electrical connector. In order to facilitate the suction of the vacuum suction nozzle, a top flat surface (or suction surface) is formed on the insulating housing of the electrical connector, so that the vacuum suction nozzle may be reliably positioned on the top flat surface of the insulating housing to suck, transfer, and accurately position the entire electrical connector on the circuit board to be soldered. The vacuum suction nozzle releases the electrical connector after being soldered, and then sucks the next electrical connector to be positioned and soldered.

However, the aforementioned known electrical connector is complicated in structure, not only because it includes a plurality of metal conductive terminals and other auxiliary parts, but also because it further includes the insulating housing to secure the aforementioned metal conductive terminals and auxiliary parts. In the manufacturing of the known electrical connector, it is necessary for the metal conductive terminals and other auxiliary parts to be assembled to the insulating housing one by one, thereby resulting in numerous process steps and a high cost.

SUMMARY

An object of the disclosure, among others, is to solve the above-mentioned problems and at least one aspect of the drawbacks in the prior art. Accordingly, an electrical connector is provided and includes a conductive terminal having a first end with a top flat surface.

BRIEF DESCRIPTION OF THE DRAWINGS

The above and other features of the invention will become more apparent by describing in detail exemplary embodiments thereof with reference to the accompanying drawings, in which.

DETAILED DESCRIPTION OF THE EMBODIMENT(S)

Figure 1:
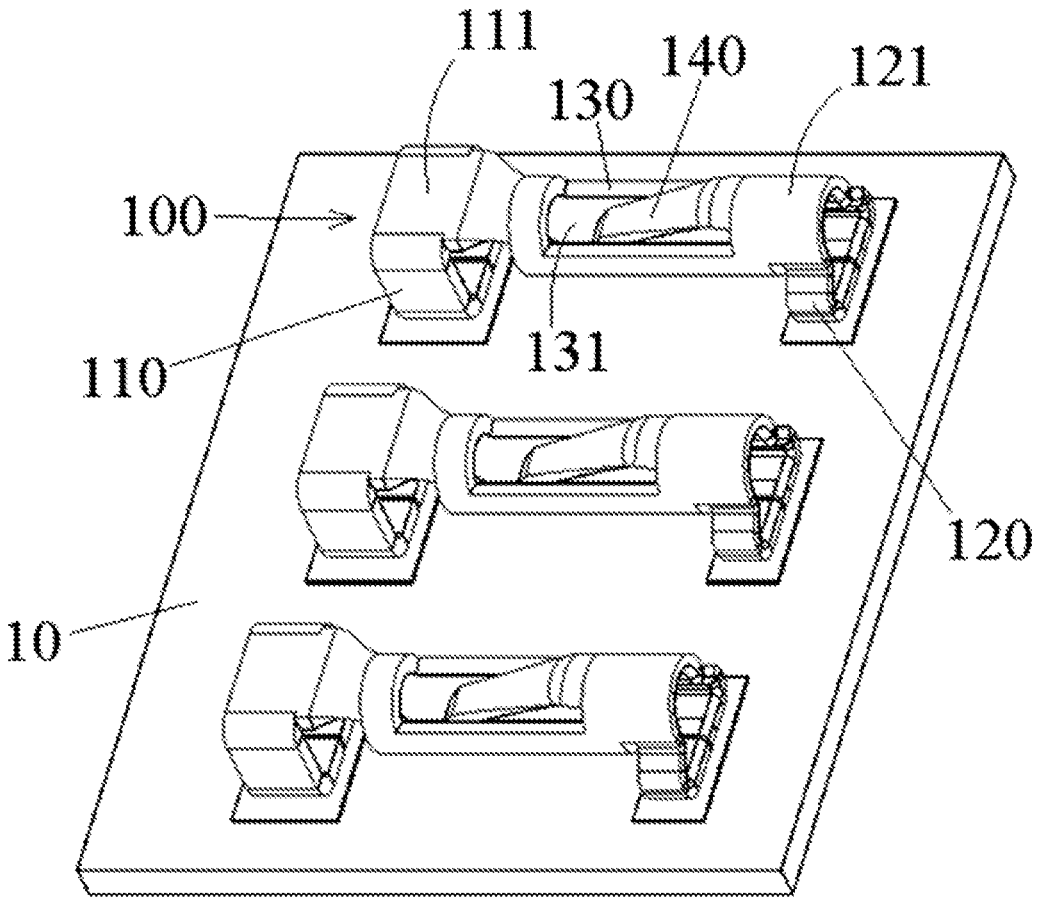
FIG. 1 is a perspective view of a plurality of electrical connectors according to the invention that is mounted to a known circuit board.

The technical solutions of the disclosure will be described in further details by means of embodiments in conjunction with the accompanying drawings. In the specification, the same or similar reference numerals indicate the same or similar parts. The following description on the embodiments of the disclosure with reference to the drawings is intended to explain the overall concept of the disclosure and should not be construed as a limitation to the disclosure.

In addition, for the purpose of explanation, numerous specific details are set forth in the following detailed description so as to provide a thorough understanding of embodiments of the present disclosure. Obviously, however, one or more embodiments may also be implemented without these specific details. In other instances, well-known structures and devices are shown in an illustrative manner so as to simplify the drawings.

With reference to FIG. 1, an electrical connector 100 according to the invention is shown and mounted to a circuit board 10. As shown, approximately three electrical connectors 100 are mounted to the circuit board 10. However, one skilled in the art should appreciate that one or more electrical connectors 100 could be used.

Figure 2:
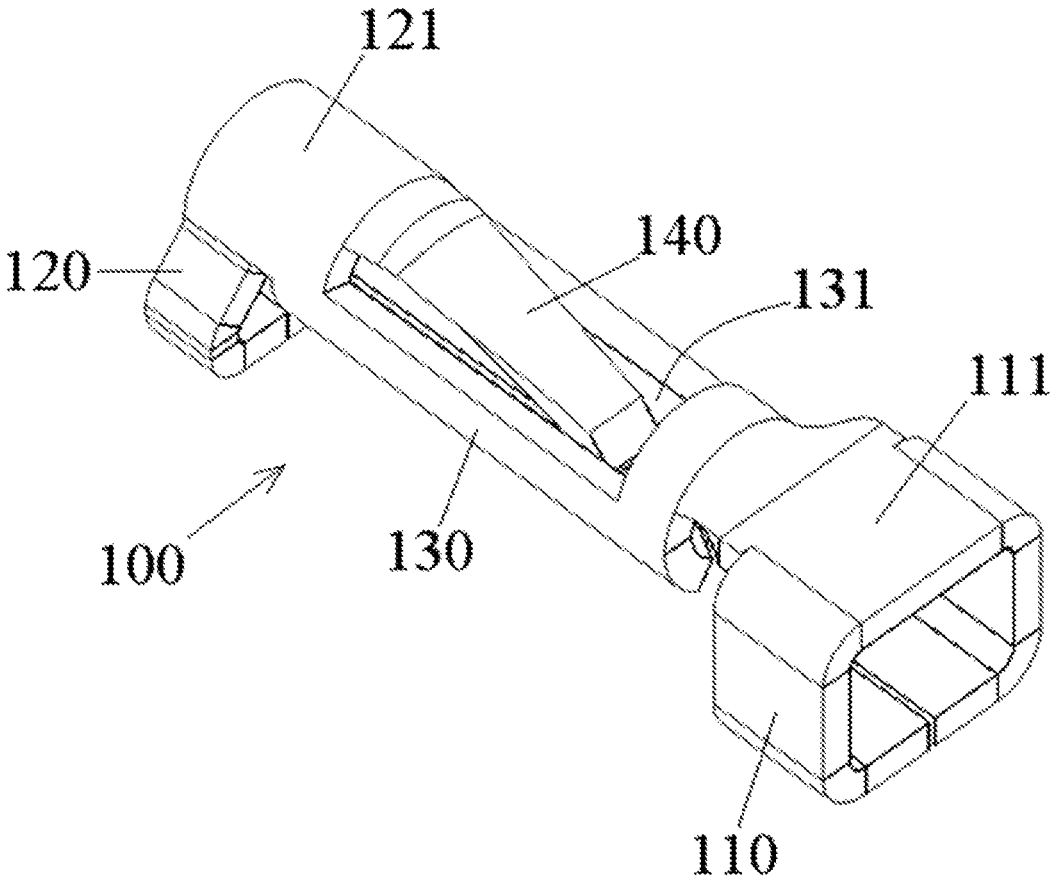
FIG. 2 is a perspective view of one of the plurality of electrical connectors shown in FIG. 1.
Figure 3:
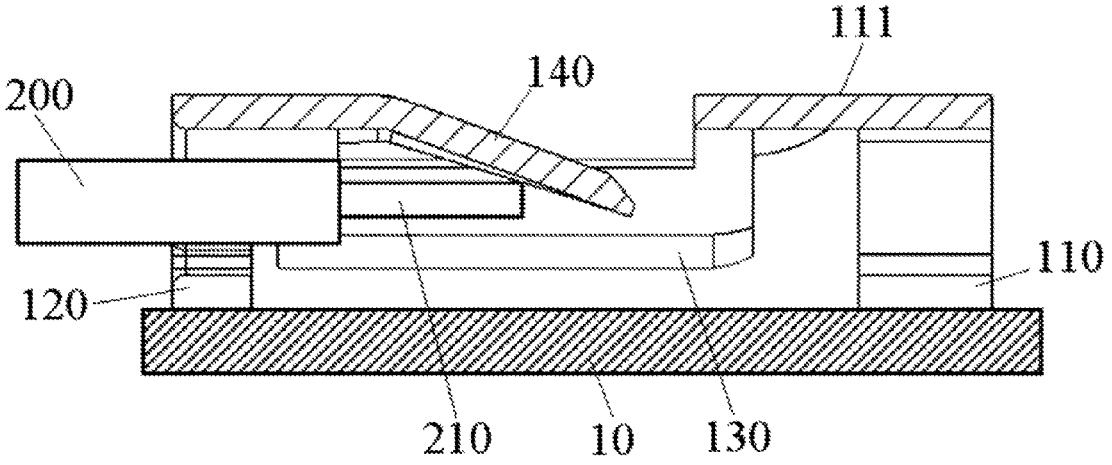
FIG. 3 is a cross-section view of the electrical connector according to the invention.

In an exemplary embodiment of the invention, as shown in FIGS. 1-3, the entire electrical connector is constituted by only one conductive terminal 100 on which a top flat surface 111 adapted to be sucked by a suction nozzle (not shown) is formed.

In the shown embodiment, as shown in FIGS. 1-3, the conductive terminal 100 includes a first end 110, a second end 120 opposite to the first end 110, and an intermediate connecting portion 130 connecting the first end 110 and the second end 120.

In an exemplary embodiment of the invention, the top flat surface 111 is disposed on top of one of the first end 110 and the second end 120 of the conductive terminal 100.

As shown in FIGS. 1-3, the first end 110 and the second end 120 of the conductive terminal 100 have a flat bottom surface adapted to be soldered to the circuit board 10 using surface mounting technology (SMT).

As shown in FIGS. 1-3, the top flat surface 111 is disposed on the top of the first end 110 of the conductive terminal 100. The second end 120 of the conductive terminal 100 is configured to be crimped onto a conductive wire 200.

The second end 120 of the conductive terminal 100 is annular shaped, so that the conductive wire 200 can be inserted into the conductive terminal 100 through the annular second end 120.

As shown in FIGS. 1-3, the conductive terminal 100 further includes a resilient cantilever 140 that is adapted to be in resiliently electrical contact with an exposed conductor core 210 of the conductive wire 200 that is inserted into the conductive terminal 100.

In an exemplary embodiment of the invention, a base of the resilient cantilever 140 is integrally connected to the second end 120. The resilient cantilever 140 extends toward the first end 110.

In the shown embodiment, as shown in FIGS. 1-3, a receiving groove 131 is formed in the intermediate connecting portion 130 and extends in an insertion direction of the conductive terminal 100. The receiving groove 131 receives the conductor core 210. The resilient cantilever 140 extends into the receiving groove 131 to make electrical contact with the conductor core 210.

In an exemplary embodiment of the invention, as shown in FIGS. 1-3, the width of the resilient cantilever 140 gradually decreases as it extends from its base to a free end thereof. As a result, the varying width improves the resilience of the resilient cantilever 140 and guarantees connection strength of the base of the resilient cantilever 140.

In an exemplary embodiment of the invention, as shown in FIGS. 1-3, the entire conductive terminal 100 is formed by cutting, punching, and bending processes of a single piece of metal material or a section of strip metal material.

It should be appreciated for those skilled in this art that the above embodiments are intended to be illustrative, and can be improved by those skilled in the art. The structures described in the various embodiments may be freely combined without a confliction of the structure or principle.

Although exemplary embodiments of the present disclosure are described in detail with reference to the attached drawings, the embodiments disclosed in the drawings are intended to be illustrative to the preferable embodiments of the present disclosure and should not be construed as a limitation to the present disclosure.

Although several exemplary embodiments of the overall concept of the present closure have been shown and described, it would be appreciated by those skilled in the art that various changes or modifications may be made in these embodiments without departing from the principles and spirit of the disclosure, the scope of which is defined in the claims and their equivalents.

It should be noted that the word "comprising" or "including" does not exclude the presence of elements or steps other than those listed in a claim, unless such exclusion is explicitly stated. The word "a" or "an" preceding an element does not exclude the presence of a plurality of such elements, unless such exclusion is explicitly stated. Further, the reference signs should not be construed as a limitation to the protection scope of the disclosure.

What is claimed is:

1. An electrical connector, comprising:

a conductive terminal having a first end with a top flat surface extending across a width of the first end and a first flat bottom surface disposed opposite the top flat surface, a semi-annular shaped second end positioned opposite to the first end and including a conductive wire receiving passageway and a second flat bottom surface positioned opposite the first end and extending parallel with the first flat bottom surface, a resilient cantilever having a base connected to the second end and extending toward the first end, and an intermediate connecting portion connecting the first end and the second end and including a conductor core receiving groove.

2. The electrical connector according to claim 1, wherein the conductive terminal is a single piece of metal material.

3. The electrical connector according to claim 1, wherein the resilient cantilever extends into the conductor core receiving groove.

4. The electrical connector according to claim 3, wherein a width of the resilient cantilever gradually decreases from the base to a free end thereof.

5. The electrical connector according to claim 4, wherein the resilient cantilever is integral with the second end.

6. An electrical connector, comprising:

a conductive terminal having a first end with a top flat surface, a semi-annular shaped second end having a flat bottom surface positioned opposite to the first end, an intermediate connecting portion connecting the first end and the second end, the intermediate connecting portion including a conductor core receiving groove, and a resilient cantilever having a base connected to the second end.

7. The electrical connector according to claim 6, wherein the second end includes a conductive wire receiving passageway.

8. The electrical connector according to claim 6, wherein the conductive terminal is a single piece of metal material.

9. The electrical connector according to claim 6, wherein the resilient cantilever extends toward the first end.

10. The electrical connector according to claim 9, wherein the resilient cantilever extends into the conductor core receiving groove.

11. The electrical connector according to claim 10, wherein a width of the resilient cantilever gradually decreases from the base to a free end thereof.

12. The electrical connector according to claim 11, wherein the resilient cantilever is integral with the second end.

* * * * *